United States Patent [19]

Madderra

[11] 4,384,691

[45] May 24, 1983

[54] ROCKET FIN HOLD DOWN SPRING

[75] Inventor: Jimmy M. Madderra, Huntsville, Ala.

[73] Assignee: The United States of America as represented by the Secretary of the Army, Washington, D.C.

[21] Appl. No.: 219,004

[22] Filed: Dec. 22, 1980

[51] Int. Cl.[3] ..... F42B 13/32

[52] U.S. Cl. ..... 244/3.27

[58] Field of Search ..... 244/3.24–3.3

[56] References Cited

U.S. PATENT DOCUMENTS

| | | | |
|---|---|---|---|
| 3,690,595 | 9/1972 | Rusbach | 244/3.27 |
| 3,754,726 | 8/1973 | Rusbach | 244/3.28 |
| 3,819,132 | 6/1974 | Rusbach | 244/3.28 |
| 3,918,664 | 11/1975 | Grosswendt | 244/3.28 |

FOREIGN PATENT DOCUMENTS

| | | | |
|---|---|---|---|
| 2280875 | 2/1976 | France | 244/3.28 |

*Primary Examiner*—Harold J. Tudor

*Attorney, Agent, or Firm*—Nathan Edelberg; Robert P. Gibson; Harold W. Hilton

[57] ABSTRACT

A missile disposed for launching from a telescoping launcher having inner and outer sections. The missile is provided with fins folded along the body. A resilient spring clip member is carried on each said fin and engages the inner surfaces of the launcher sections as the missile traverses the launcher to retain the fins in folded position in the launcher.

1 Claim, 5 Drawing Figures

ROCKET FIN HOLD DOWN SPRING

DEDICATORY CLAUSE

The invention described herein may be manufactured, used, and licensed by or for the Government for governmental purposes without the payment to me of any royalties thereon.

BACKGROUND OF THE INVENTION

In some missile systems the missile is provided with folding fins and the missile is fired from a telescoping launcher/carrier and must transition from a large tube to a small tube. The fins must be held down to the missile diameter (small tube diameter also) at all times (launcher collapsed) launcher extended and during firing.

In the past, a sabot type of restrainer was used as the hold down device and also as a bore rider to guide the missile along the tube. However, this device was made of a material that changed physical properties during storage. Also, the missile moved quite a distance down the tube before the restrainer engaged the shoulder of the smaller tube causing the sabot type of restrainer to disintegrate. The device of the present invention is a resilient metallic spring member which replaces the hold down function of the sabot type restrainer and will not shatter or disintegrate.

SUMMARY OF THE INVENTION

The hold down device is a spring clip having two spring loops joined at one side with a crossover wire, and trailing legs extending from the loops. The hold down device straddles the fin with a crossover wire in a notch in the fin and the trailing legs engaging the posts on which the fins are mounted. A plurality of fins are disposed circumferentially around the aft end of the missile motor.

DESCRIPTION OF THE PREFERRED EMBODIMENT

Figure 1:
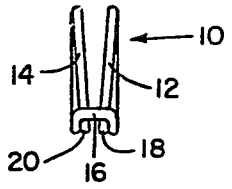
FIG. 1 is a front view of the hold down spring.

As seen in FIG. 1 the hold down spring 10 includes two loops 12 and 14 joined by a crossover member 16. The spring further includes a pair of legs 18 and 20 (FIGS. 1 and 2) extending from the loops.

Figure 2:
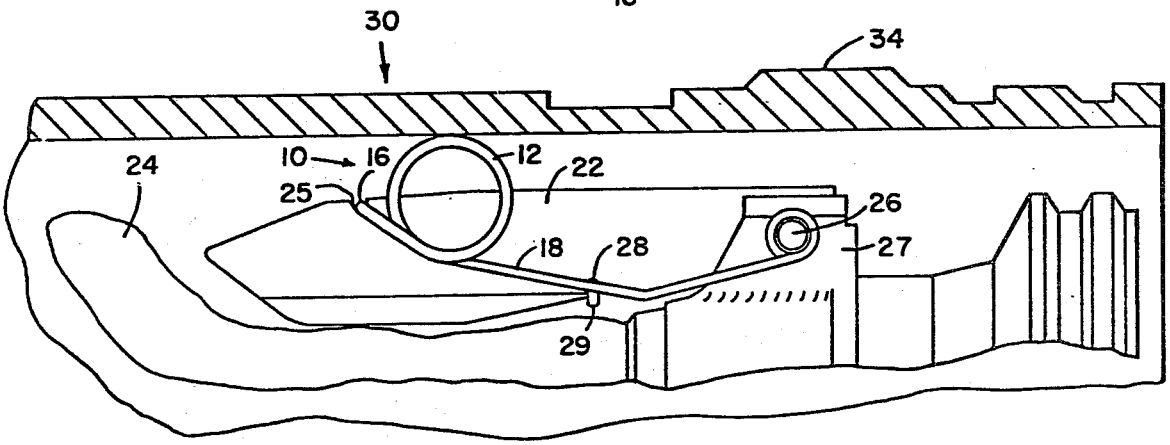
FIG. 2 is a partial elevational view of the missile in the larger (outer) tube of the launcher.

As seen in FIG. 2 spring clip 10 is mounted on a fin 22 of missile 24. Crossover portion 16 is positioned in a notch 25 of fin 22. Each loop 12 and 14 are positioned on opposite sides of fin 22. Each trailing leg (only leg 18 is shown) extends from its respective loop to fit loosely around mounting shaft 26 for each fin. The shaft 26 extends through a pair of spaced members 27 on which each fin is mounted. A plurality of members 27 are carried circumferentially around the missile body for support of each fin. An erecting spring 28 includes one end 31 secured to shaft 26 and a second end 29 engaging the bottom of the fin for extending the fin outwardly when the missile clears the launcher. The erecting spring may be any of many erecting springs known in the art. For example, an erecting spring such as that shown in the patent to Werner Crosswendt, entitled "Launchable Missile Having a Tail Unit", U.S. Pat. No. 3,918,664, issued Nov. 11, 1975, may be resorted to if desired.

FIG. 2 illustrates the position of the hold down device in the outer or larger diameter section 34 of launcher 30. Spring 10 is somewhat elevated above fin 22 to engage the inner surface of the tube.

Figure 3:
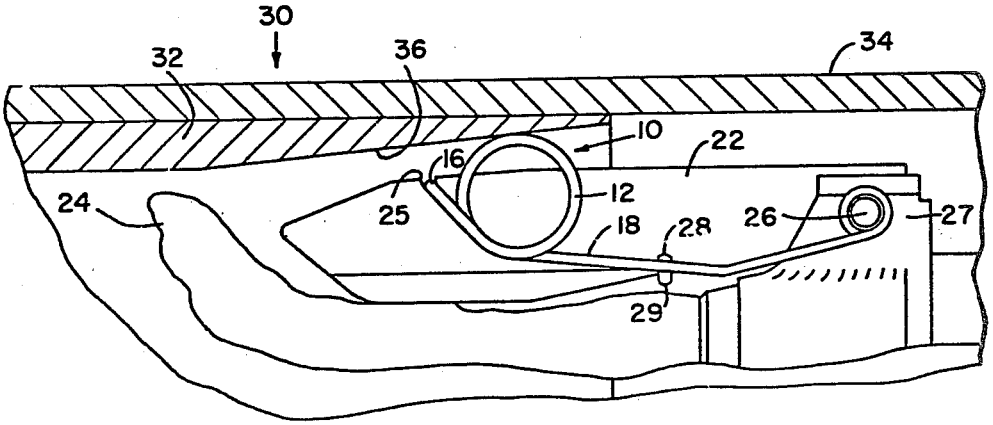
FIG. 3 is a partial elevational view of the missile in the transition ramp.

FIG. 3 illustrates launcher 30 inner and outer sections 32 and 34. The FIGURE illustrates loops 12 and 14 of hold down spring 10 somewhat compressed while engaging the tapered ramp portion 30 of the inner launch tube.

Figure 4:
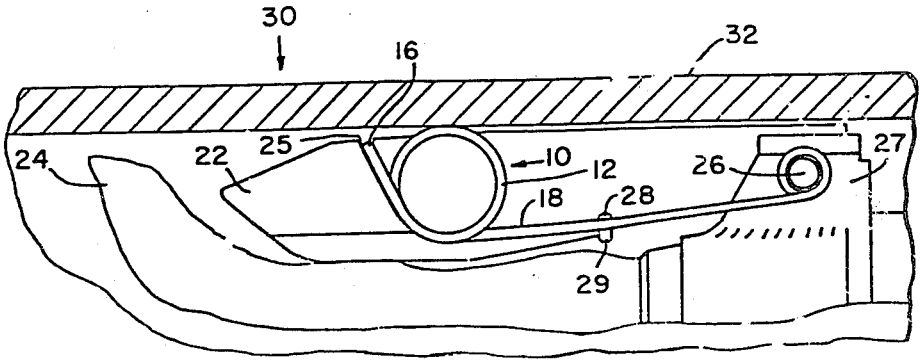
FIG. 4 is a partial elevational view of the missile in the smaller (inner) tube of the launcher.
Figure 5:
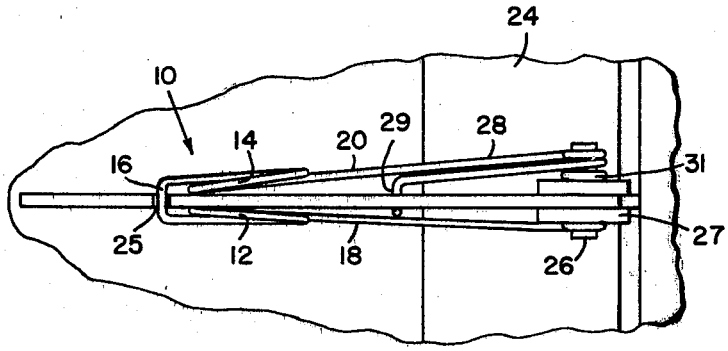
FIG. 5 is a partial elevational top view of the rocket illustrating the hold down spring and erecting spring used in the present invention.

FIG. 4 illustrates the fins in the smaller diameter (inner) section of the launcher. Loops 12 and 14 of hold down spring 10 are compressed downwardly but firmly engage the inner surface of the inner launch tube 32.

In operation, as the missile travels the length of the launch tube, the spring extends outwardly to engage the inner surface of the larger diameter tube, then the spring is somewhat compressed in the transition ramp portion of the launch tube, and, finally the spring is completely compressed and engaged with the inner surface of the smaller diameter tube in this portion of the tube. When the missile exits the launcher, the fins erect and the spring clips are discarded automatically (because they are loosely mounted on shaft 26) to achieve a clean configuration.

I claim:

1. A missile disposed for launching from a telescoping launcher having inner and outer sections, said inner section having a smaller internal diameter than said outer section, said missile having fins folded forwardly along the body thereof and shafts secured thereto for pivotally supporting said fins, said fins movable to an unfolded position responsive said missile leaving said launcher, fin hold down means for retention of said fins in the folded position prior to said missile leaving said launcher, said hold down means including a resilient spring clip having a pair of spring loops joined by a crossover portion and a pair of trailing leg portions extending on opposite sides of said fins and disposed for loosely secured relation to said shafts, said loop portions disposed for engaged relation with the inner surfaces of said tubes, said fins being further provided with a notch thereon for seating said crossover portion of said spring therein.

* * * * *